US005499562A

United States Patent [19]

Feng

[11] Patent Number: 5,499,562

[45] Date of Patent: Mar. 19, 1996

[54] EXCHANGEABLE TYPE SCREWDRIVER WITH WORK-HEAD STORAGE MODULE(S)

[76] Inventor: Yee-Chang Feng, 2F.,No. 166-5,Sec.3,Hsi-Tun Rd., Taichung, Taiwan

[21] Appl. No.: 260,329

[22] Filed: Jun. 15, 1994

[51] Int. Cl.[6] ..... B25G 1/08

[52] U.S. Cl. ..... 81/177.4; 81/438; 81/490

[58] Field of Search ..... 81/177.4, 450, 81/437, 438, 439, 177.1, 489

[56] References Cited

U.S. PATENT DOCUMENTS

| | | | |
|---|---|---|---|
| 1,309,281 | 7/1919 | Forbes | 81/490 |
| 2,409,613 | 10/1946 | Brooks | 81/177.4 |
| 2,448,168 | 8/1948 | Banister | 81/439 |
| 4,227,430 | 10/1980 | Jansson et al. | 81/177.4 |
| 4,278,119 | 7/1981 | Elmore | 81/490 |
| 4,399,723 | 8/1983 | Marleau | 81/438 |

FOREIGN PATENT DOCUMENTS

| | | | |
|---|---|---|---|
| 3004958 | 8/1981 | Germany | 81/439 |

*Primary Examiner*—Bruce M. Kisliuk
*Assistant Examiner*—Joni B. Danganan
*Attorney, Agent, or Firm*—Bacon & Thomas

[57] ABSTRACT

An exchangeable screwdriver with work-head storage module(s) mainly consisting of a support, a shank disposed in front of the support for connecting at its front end an exchangeable work-head, and at least one cabin type module detachably connected to a rear portion of the support and, together with the support, forming a handle of the screwdriver. Each of the cabin type modules has a plurality of holes provided at its front surface to each stably receive a spare exchangeable work-head therein. Multiple cabin type modules may be sequentially connected together to provide work-head storage space that is not limited by the size of a general screwdriver handle, so that the storage and carrying of multiple spare exchangeable work-heads can be more convenient.

1 Claim, 7 Drawing Sheets

EXCHANGEABLE TYPE SCREWDRIVER WITH WORK-HEAD STORAGE MODULE(S)

BACKGROUND OF THE INVENTION

1. Field of the Invention

The present invention relates to an exchangeable type screwdriver with work-head storage module(s), and more particularly to an exchangeable type screwdriver with work-head storage module(s) which facilitates a user to conveniently select any suitable work-head from the work-head storage modules provided with the screwdriver to work on screws of various types and sizes in the work site.

2. Summary of the Prior Art

It is indeed convenient for a user to have an exchangeable type screwdriver when he is facing many different types and sizes of screws during working. However, a new problem faced by the user with the exchangeable type screwdriver is that he has to take care of various exchangeable work-heads of different types and sizes. An exchangeable type screwdriver with work-head storage module(s) was developed to solve this problem.

Please refer to FIG. 1 in which a conventional exchangeable type screwdriver cap able of storing work-heads is shown. Such conventional screwdriver has a handle 01 being internally formed with a plurality of long chambers 02 for containing spare work-heads 04 therein. The chambers 02 each has an internal diameter slightly larger than the diameter of work-heads 04 to be stored inside the chambers 02. A sleeve 03 is detachably engageable with the handle 01 to close the chambers 02 and prevent the work-heads 04 from falling out of the chambers 02.

Please refer to FIG. 2 in which another conventional exchangeable type screwdriver capable of storing spare work-heads is shown. Such conventional screwdriver has a hollow handle 11 to provide a hollow tubular storage chamber 12 therein for containing more work-heads 04. A rear cover 13 is used to open or close the storage chamber 12 by engaging threads 15 formed on the cover 13 with threads 16 provided at a rear end of the handle 11.

Both of the above two conventional exchangeable type screwdrivers have the following disadvantages:

1. As shown in FIG. 1, only limited storage space for spare work-heads can be provided by the handle 01 due to its fixed dimensions and, accordingly, only limited types and sizes of work-heads can be stored in the chamber 02. That is, the exchangeable type screwdriver fails to provide the real "exchangeable" effect.
2. As shown in FIGS. 1 and 2, when one of the spare work-heads 04 is to be selected for use, all the spare work-heads 04 have to be dumped from the storage chamber 02 or 12 onto a support surface. After the selection is made, the remaining work-heads 04 have to be collected and replaced into the storage chamber 02 or 12 again. Such dumping, collecting, and replacing of spare work-heads 04 are of course inconvenient and the work-heads are easily lost, especially in a disordered work site.
3. As shown in FIG. 2, spare work-heads 04 are individually stored in the chamber 12 without being fixed thereto and, therefore, they tend to freely move or shift within the chamber 12 and adversely affect the use of such conventional exchangeable type screwdriver.

It is therefore a purpose of this invention to provide an exchangeable type screwdriver with work-head storage module(s) which eliminate the above mentioned disadvantages of the conventional exchangeable type screwdrivers.

SUMMARY OF THE INVENTION

A primary object of the present invention is to provide an exchangeable type screwdriver with work-head storage module(s) which provides extended storage space for spare exchangeable work-heads without being limited by the dimensions of the screwdriver handle.

Another object of the present invention is to provide an exchangeable type screwdriver with work-head storage module(s) which enable s the user to quickly and conveniently locate a desired work-head to complete the exchange of work-heads during work without the need to dump all the spare work-heads onto a support surface selection. The possible loss of work-heads in a disordered work site can the before be avoided.

A further object of the present invention is to provide an exchangeable type screwdriver with work-head storage module(s) wherein the spare exchangeable work-heads are securely loaded and fixed in the storage module(s) and without being subjected to shifting and shaking when the screwdriver is in use.

To achieve the above mentioned objects, the exchangeable type screwdriver with work-head storage module(s) mainly consists of a group of detachably connected cabin type modules for storing therein multiple spare exchangeable work-heads of different types and sizes. When any one of the cabin type modules is connected to a support of the screwdriver, the cabin type module together with the support form a part of or a whole handle of the screwdriver. When multiple cabin type modules connect one another in a continuous manner, they provide a work-head storage space unlimited by the size of the screw-driver handle. The cabin type modules may be designed to have different cross sections, such as round, square, hexagonal, and other shapes. The manner in which the cabin type module is engaged into the support of the screw-driver may be different, too, including inserting, screwing, snapping the cabin type module into the support, or other manners. The spare exchangeable work-heads may be stored in each cabin type module based on different types and sizes or on the preference of the user for easy selection or carrying. Since all the stored exchangeable work-heads can be clearly viewed, selected, and removed when the cabin type module(s) is detached from the support, the cabin type module(s) may be quickly attached to the support again after a desired exchangeable work-head is selected.

BRIEF DESCRIPTION OF THE DRAWINGS

The detailed structure, functions, and effects of the present invention can be best understood by referring to the following detailed description of the preferred embodiments and the accompanying drawings, wherein.

DETAILED DESCRIPTION OF THE PREFERRED EMBODIMENTS

Figure 1:
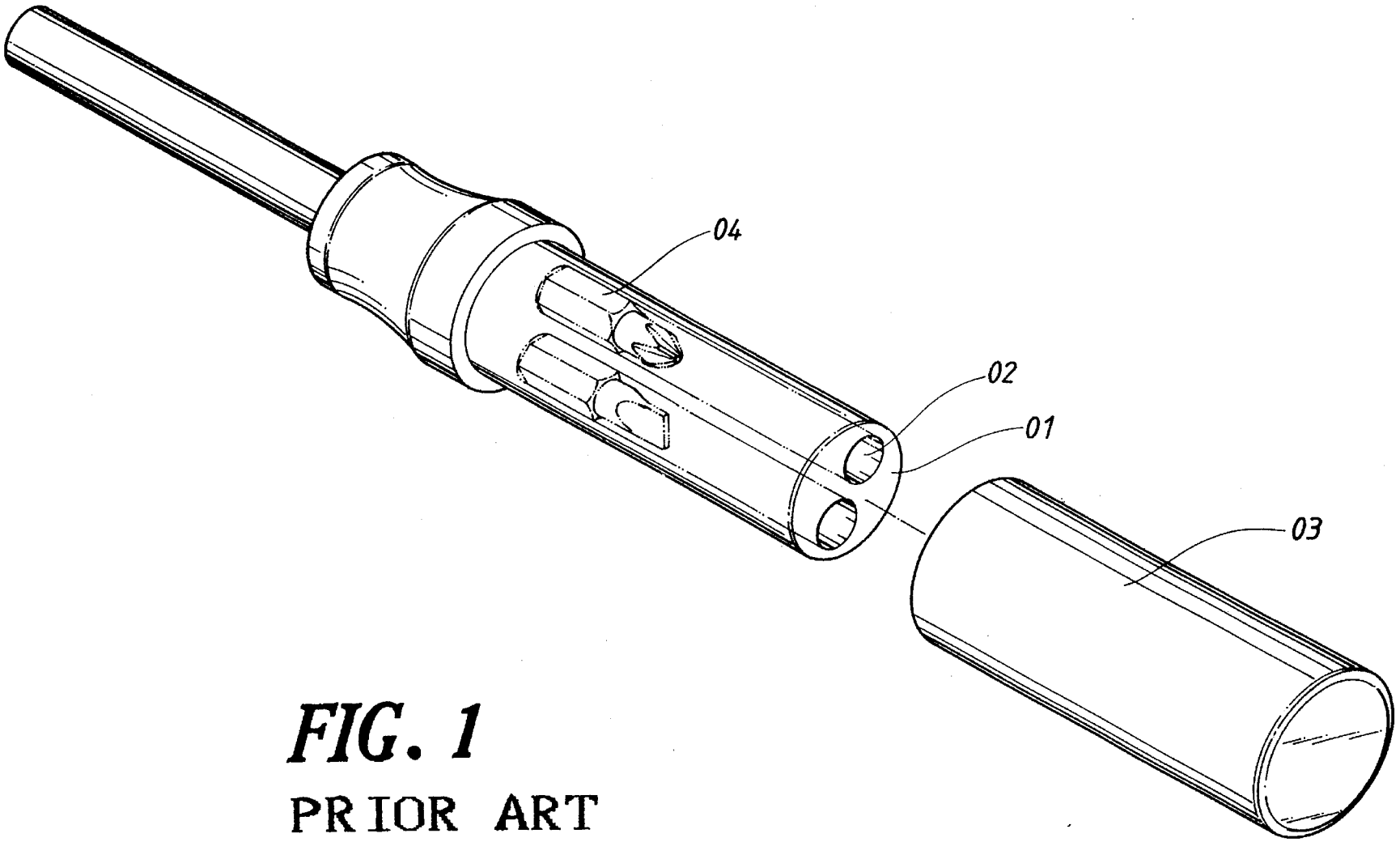
FIG. 1 PRIOR ART
FIG. 1 is a perspective view conventional exchangeable type screwdriver capable of storing spare work-heads.
Figure 2:
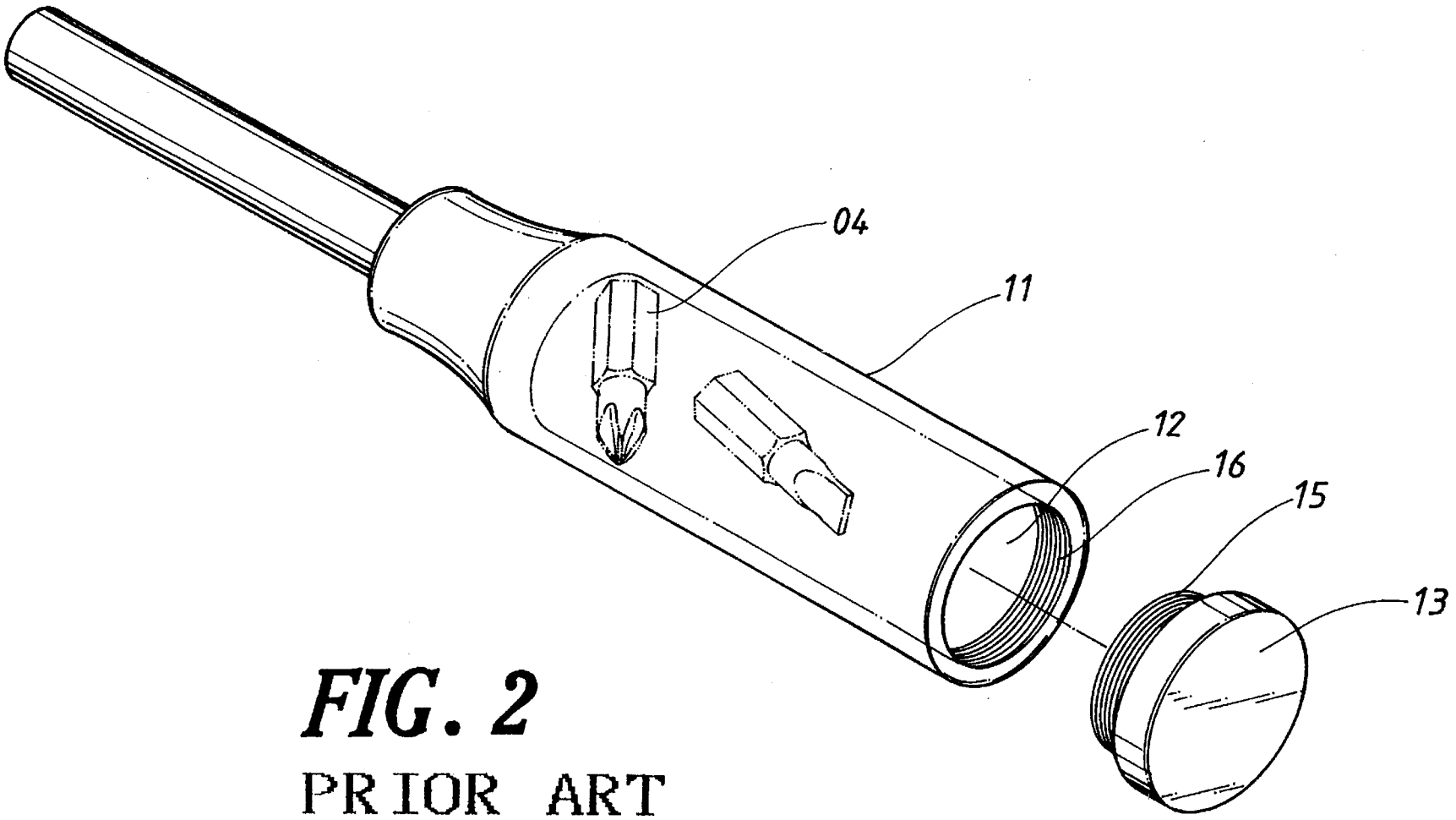
FIG. 2 PRIOR ART
FIG. 2 is a perspective view another conventional exchangeable type screwdriver capable of storing spare work-heads.
Figure 3:
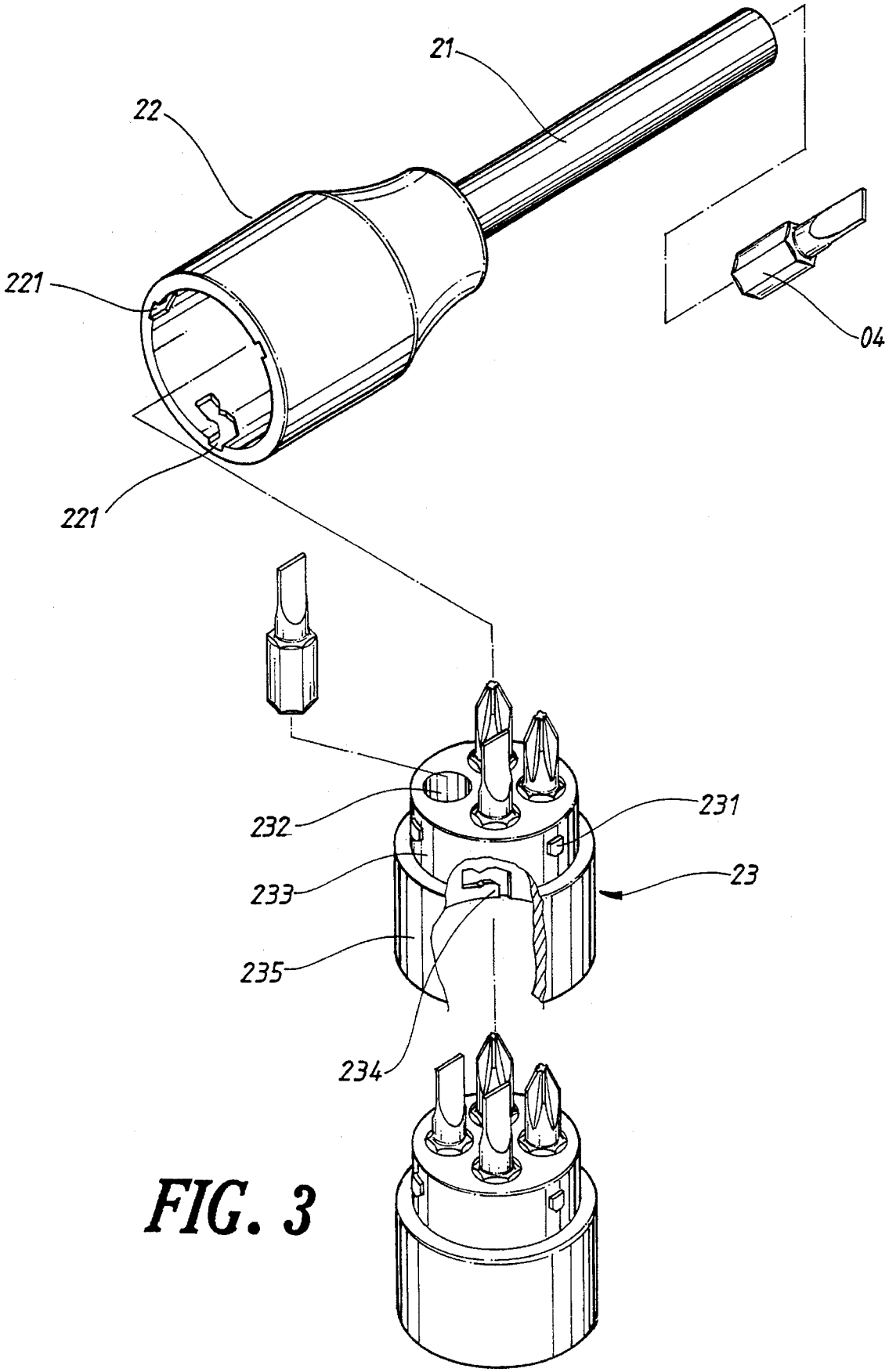
FIG. 3 is an exploded perspective view of a first embodiment of an exchangeable type screwdriver with work-head storage modules according to the present invention.

Please refer to FIG. 3 which shows the first embodiment of an exchangeable type screwdriver with work-head storage module(s) according to the present invention. The screwdriver mainly consists of a front shank 21 for receiving at its front end a selected exchangeable work-head, a support 22 located behind and connecting with the front shank 21, and at least one cabin type module 23 detachably connected to the support 22 for storing spare exchangeable work-heads therein.

The support 22, especially a rear portion thereof, is substantially a hollow round socket. A plurality of mortises 221 are formed on the rear inner periphery of the support 22.

The cabin type module(s) 23 each has a front portion 233 and a rear portion 235. The front portion 233 has a round cross section having a diameter slightly smaller than an internal diameter of the hollow socket portion of the support 22. A plurality of tenons 231 are circumferentially formed on an outer side wall of the front portion 233, and correspond to the mortises 221 formed on the rear inner periphery of the support 22. The cabin type module 23 is connected with the support 22 by the engagement of the tenons 231 with the mortises 221. A plurality of axially extended holes 232 are formed on a top surface of the front portion 233 for each accommodating a work-head 04 therein. The rear portion 235 of the cabin type module 23 is also a hollow round socket having a plurality of mortises 234 formed on a rear inner periphery thereof. The positions, configuration, and dimensions of the mortises 234 all correspond to those of the mortises 221. By this way, more than one cabin type module 23 can be axially and sequentially connected. However, the radial engagement of the support 22 with the cabin type module 23 is not necessarily in a plane normal to a longitudinal axis of the support 22.

The user may collect and group the work-heads 04 by type, size, or personal preference, and separately insert the same into the holes 232 of a cabin type module 23. Multiple cabin type modules 23 can be used to store different work-heads 04 and be joined together in the manner as described above for the user to conveniently carry large numbers of spare exchangeable work-heads 04 for exchange at any time.

Figure 4:
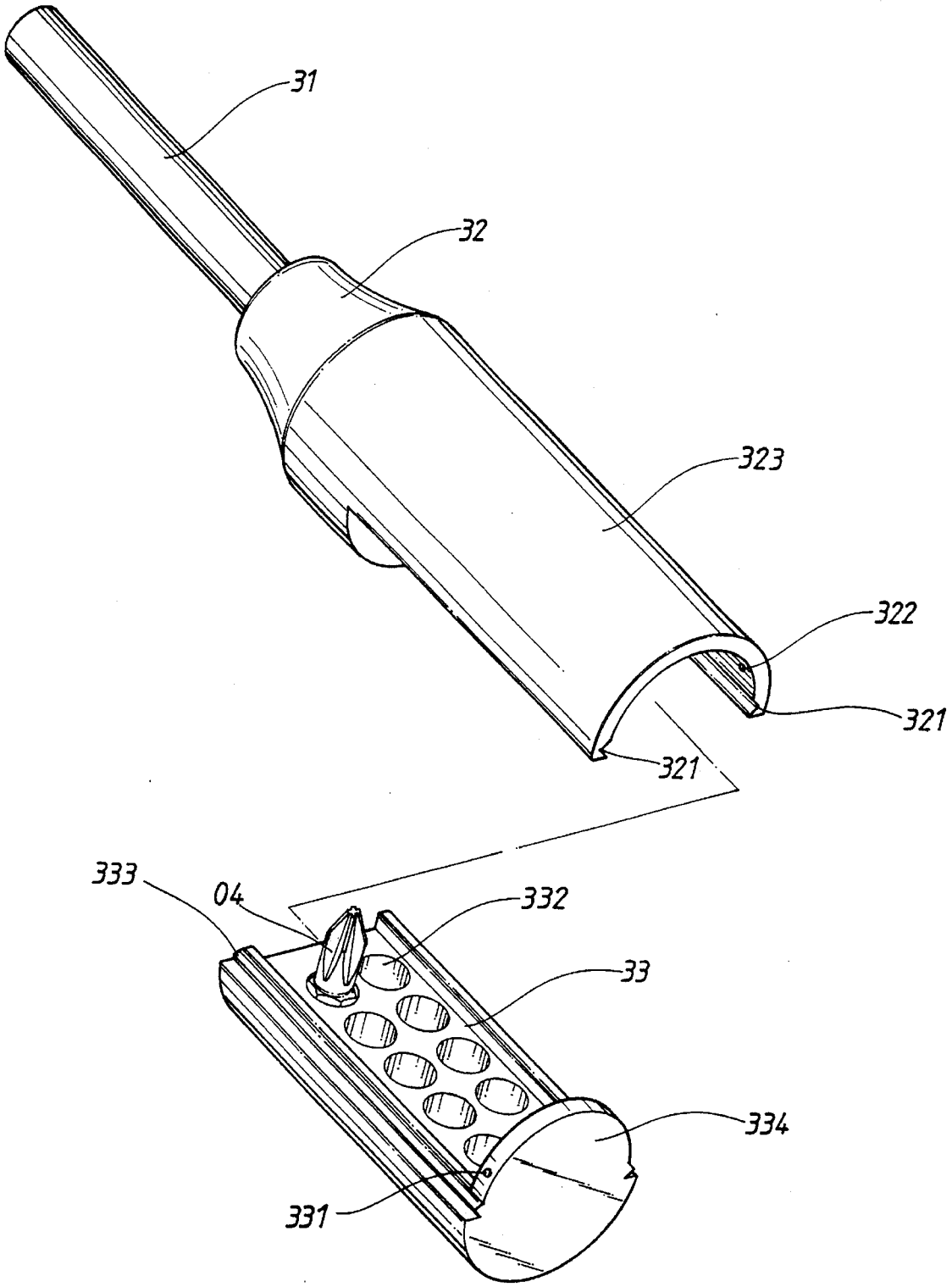
FIG. 4 is an exploded perspective view of a second embodiment of the exchangeable type screwdriver with work-head storage modules according to the present invention.

FIG. 4 illustrates a second embodiment of the present invention, including a shank 31, a support 32, and a cabin type module 33. The support 32 also has canopy 323 in the form of a hollow round rear portion side portion wall of which has been removed so that it has a rear cross section like a canopy. Two longitudinal sides of the canopy 323 are each provided with a dovetail groove 321. Adequate numbers of pits 322 are further formed on a rear inner periphery of the canopy 323.

The cabin type module 33 is a body having a substantially semi-circular cross section with an integrally formed round end plate 334 to close the end opening of the canopy 323. There are bosses 331 formed on the end plate 334 such that they correspond to and engage into the pits 322. Two axially extended flange ribs 333 are formed at two longitudinal sides of the cabin type module 33, enabling the latter to securely join with the canopy 323 by engaging the flange ribs 333 with the dovetail grooves 321 of the canopy 323. The engagement of the bosses 331 with the pits 322 further secures the stable connection of the cabin type module 33 to the support 32. A plurality of holes 332 are provided on a flat plane of the semi-circular cabin type module 33 to accommodate spare exchangeable work-heads 04 therein. However, the axial engagement of the cabin type module 33 with the support 32 is not necessarily in a plane parallel to a longitudinal cross-section of the support 32.

Figure 5:
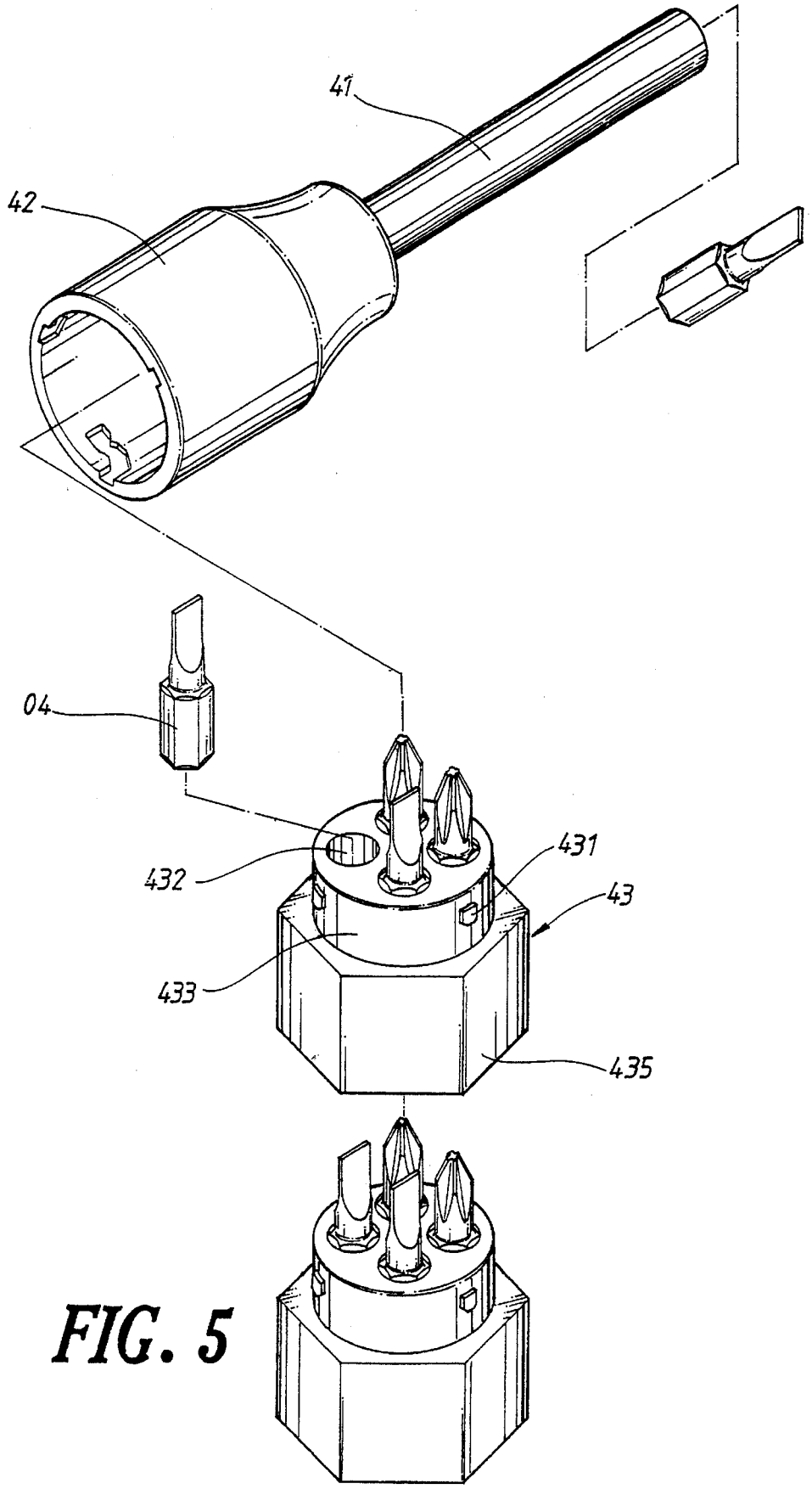
FIG. 5 is an exploded perspective view of a third embodiment of the exchangeable type screwdriver with work-head storage module according to the present invention.

FIG. 5 illustrates a third embodiment of the present invention, including a shank 41, a support 42, and at least one cabin type module 43 having a front portion 433, a rear portion 435, a plurality of work-head storing holes 432, and a plurality of tenons 431 and mortises (not shown). This embodiment is similar to the first embodiment of the present invention as shown in FIG. 3, except that the rear portion 435 of the cabin type module 43 has a hexagonal cross section.

Figure 6:
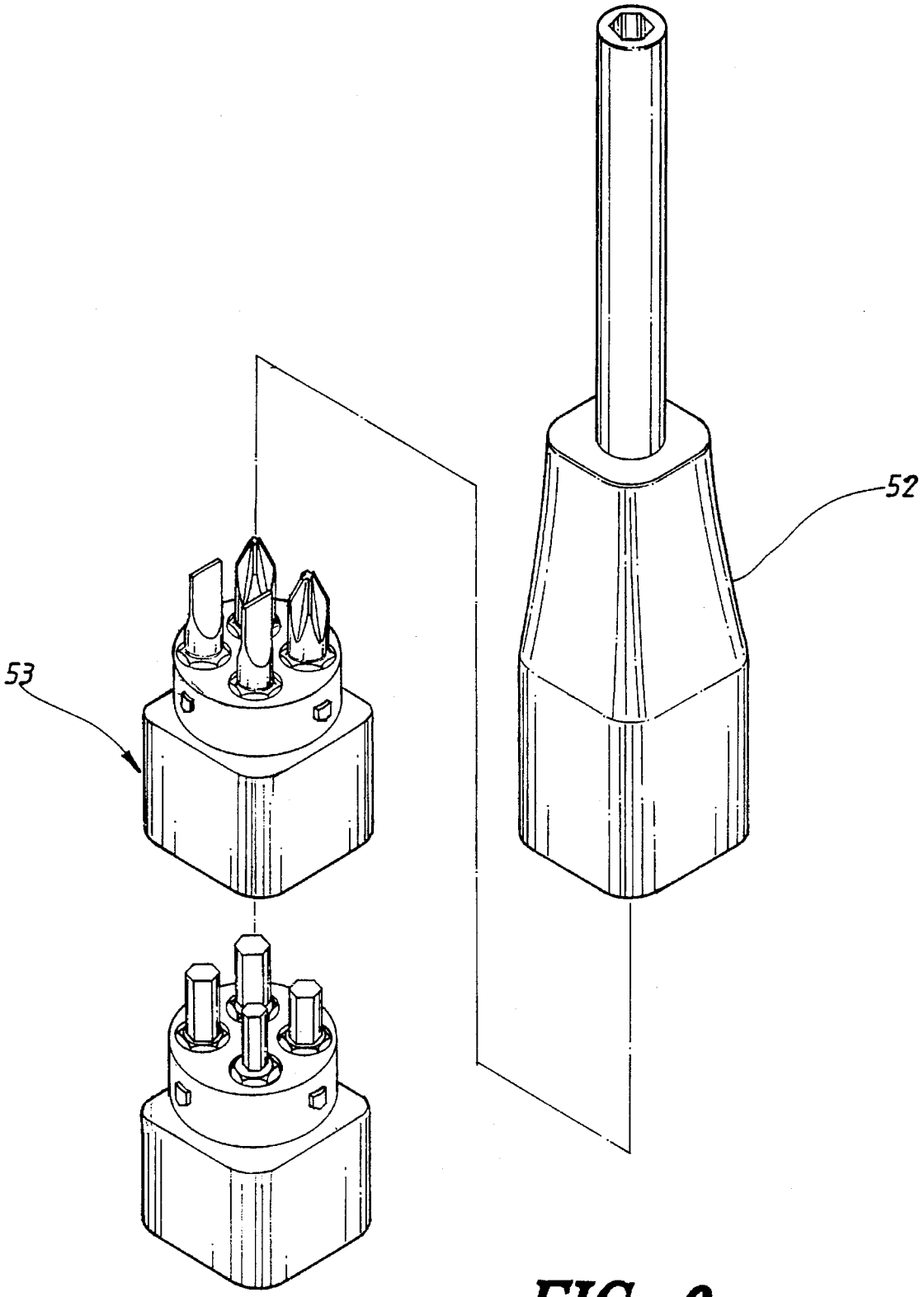
FIG. 6 illustrates a fourth embodiment of the exchangeable type scewdriver with work-head storage modules according to the present invention.

FIG. 6 illustrates a fourth embodiment of the present invention, including a shank, a support 52, and at least one cabin type module 53. This embodiment is similar to the first and the third embodiments, except that the support 52 has a rear portion having a square cross section.

Figures 7, 7A:
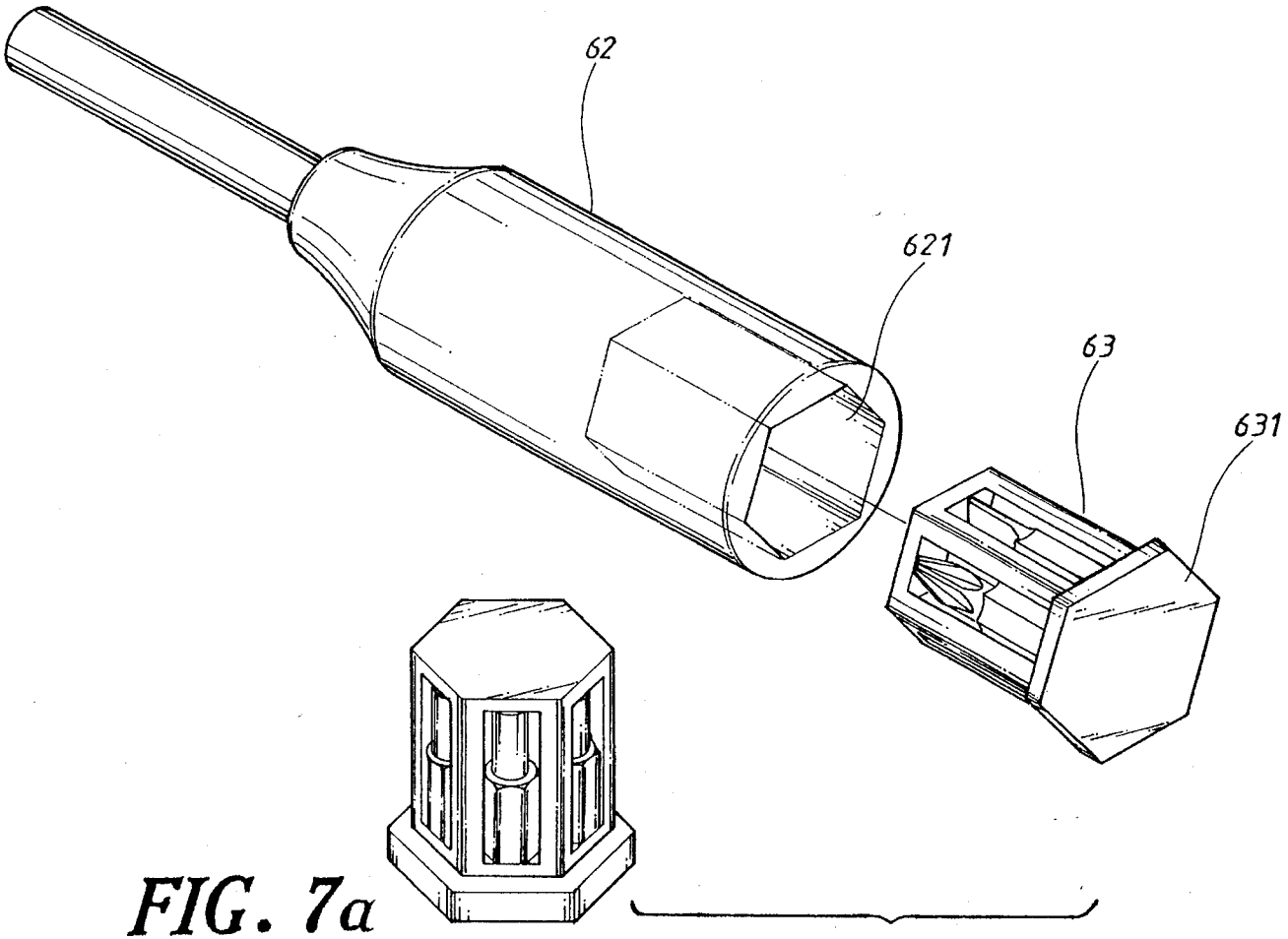
FIG. 7 illustrates a fifth embodiment of the exchangeable type screwdriver with work-head storage modules according to the present invention.

FIG. 7 illustrates a fifth embodiment of the present invention, including a shank, a support 62, and a cabin type module 63 for carrying multiple work-heads therein. The support 62 has a rear chamber 621 formed in a rear portion thereof for the cabin type module 63 to insert thereinto. The cabin type module 63 has an end plate 631 of which the outer periphery laterally projects outwardly of an outer periphery of the support 62, so that the cabin type module 63 can be easily removed from the chamber 621 by pulling the end plate 631 outward relative to the support 62. Alternatively, the projected outer periphery of the end plate 631 can be replaced with a pull ring or other similar parts connected to a bottom surface of the end plate 631.

In any one of the above embodiments of the present invention, compression spring(s) and other types of engaging mechanisms may be further mounted in the rear hollow chamber of the support and in the front portion of the cabin type module, so that the cabin type module can be pressed into the support and automatically engages with the latter. A push button may be provided outside the support for automatically springing the cabin type module out of the support by just depressing the push button.

With the above arrangements, the exchangeable type screwdriver with work-head storage module(s) according to the present invention may effectively expand the storage space directly provided by the screwdriver for more spare exchangeable work-heads. Moreover, the stored work-heads can be stably fixed in the storage space without interfering with the manipulation of the screwdriver, and can be conveniently put into or removed from the cabin type module, avoiding the possibility of carelessly losing the work-heads during their exchange. Therefore, the present invention is novel, practical and effective in use.

It is to be understood that the above description and drawings are only used for illustrating some of the embodiments of the present invention, and are not intended to limit the scope of the present invention. Any variation and derivation from the above description and drawings should be included in the scope of the present invention.

What is claimed is:

1. A screwdriver comprising:

a) a shank having a front end for detachably securing a selected work head thereon;

b) a support connected to the shank, the support including a longitudinal axis, a canopy having a substantially semi-circular cross section, a pair of dovetail-groove longitudinal edges, and a pair of pits formed adjacent a rear inner periphery of the canopy; and c) a module having a substantially-circular cross section defining a pair of longitudinal sides, the module including a pair of axially extending flange ribs formed at the longitudinal sides for detachable engagement with the dovetail-groove longitudinal edges of the canopy in a direction which is substantially parallel with the longitudinal axis of the support, a plurality of holes for storing spare work heads, and a pair of bosses provided on a rear portion of the module for detachable engagement with the pits of the canopy.

* * * * *